United States Patent [19]

Riggi

[11] Patent Number: 4,811,876

[45] Date of Patent: Mar. 14, 1989

[54] SHOULDER STRAP RETAINER

[76] Inventor: Michael S. Riggi, 39 Parkhaven Dr., Tonawanda, N.Y. 14150

[21] Appl. No.: 157,059

[22] Filed: Feb. 16, 1988

[51] Int. Cl.[4] ..... A45F 15/02

[52] U.S. Cl. ..... 224/264; 224/901; 2/268; 450/81

[58] Field of Search ..... 224/264, 901, 203, 205, 224/242, 257, 907; 2/268; 450/81

[56] References Cited

U.S. PATENT DOCUMENTS

| | | | |
|---|---|---|---|
| 2,476,712 | 7/1949 | Eisenberg | 2/268 |
| 3,052,886 | 9/1962 | White | 224/264 |
| 4,168,544 | 9/1979 | Kallman | 224/901 X |
| 4,343,313 | 8/1982 | Le Jeune | 450/81 |

*Primary Examiner*—Renee S. Luebke

*Attorney, Agent, or Firm*—Bean, Kauffman & Spencer

[57] ABSTRACT

A retainer for positionally locating a shoulder strap of a handbag or the like relative to the shoulder of a user includes a base member carrying an adhesive for removably attaching the retainer to the skin on the shoulder of the user and a retainer member arranged to upstand from the base member and provide a recess for receiving the shoulder strap.

11 Claims, 1 Drawing Sheet

Fig. 1.
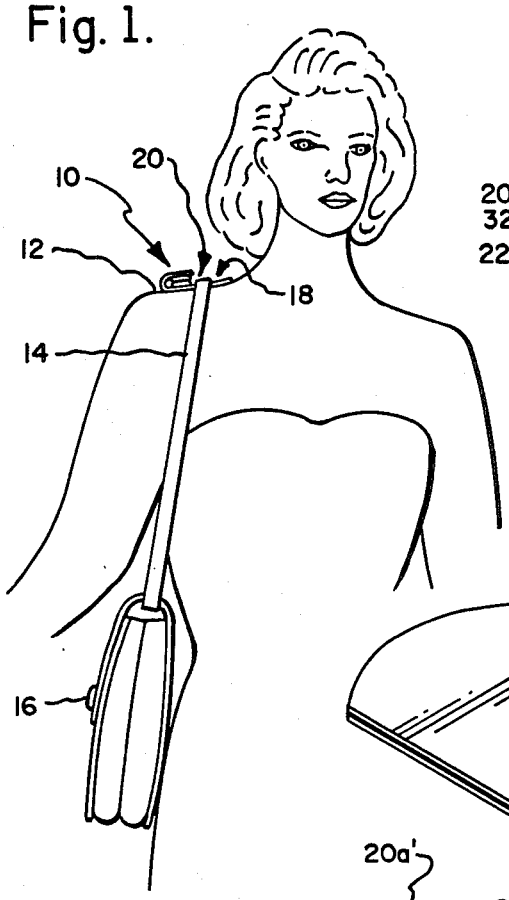
Fig. 3.
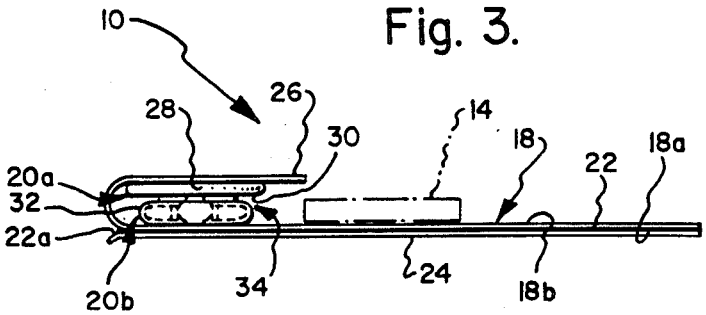
Fig. 2.
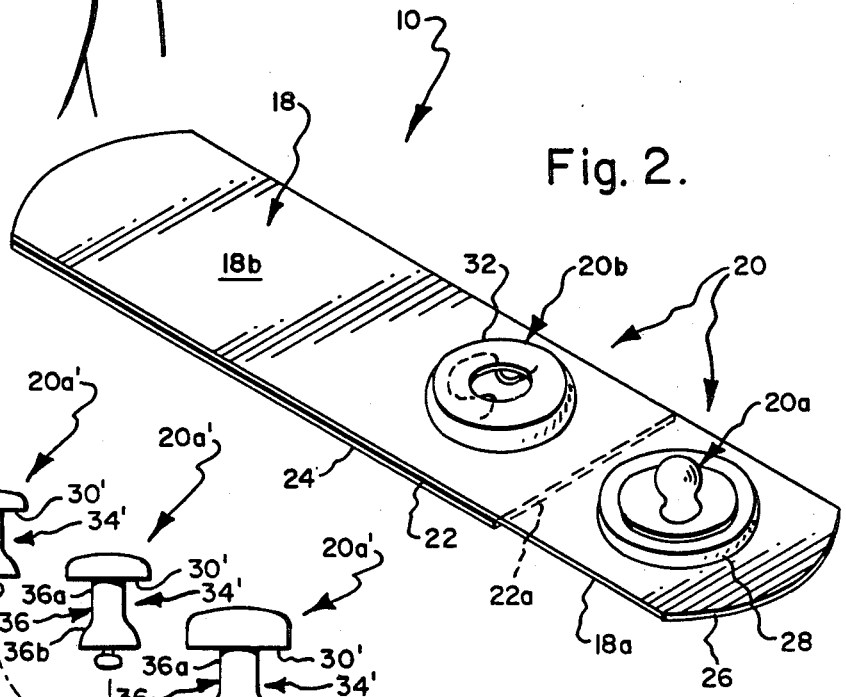
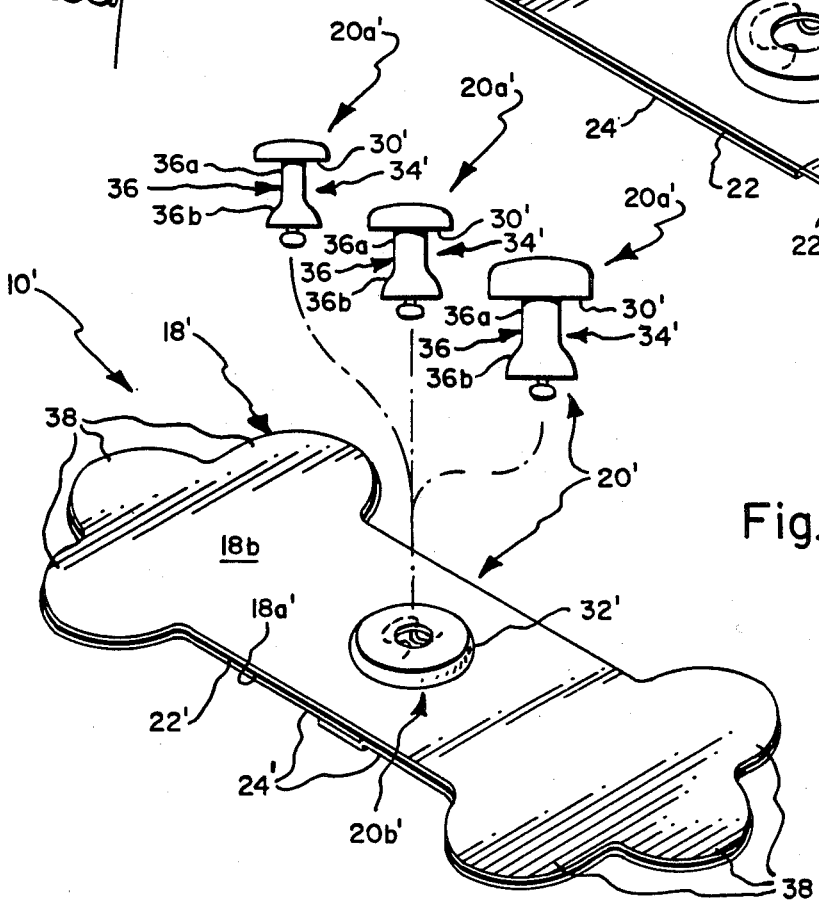
Fig. 4.

SHOULDER STRAP RETAINER

BACKGROUND OF THE INVENTION

Shoulder bags have become a popular accessory, but many persons find their use to be aggravating, due to the tendency of shoulder bag straps to slide along and sometimes off the user's shoulder.

Heretofore, it has been proposed to overcome problems associated with sliding of shoulder bag straps by providing garments with shoulder bag strap retaining strips of cloth or the like, which have one end permanently attached to the garment and an opposite end releasably attached to the garment by a button or snap fastener, so as to removably enclose or encircle the shoulder bag strap. It has also been proposed to removably fix a shoulder bag strap retaining hook to the shoulder of a garment by means of a safety pin.

The foregoing solutions either require modification in the structure of a user's garment or create unsightly holes therein. Further, neither of these solutions is applicable for situations where the user is wearing a strapless swim suit or other garment, which affords no garment material to which a shoulder bag strap may be attached.

SUMMARY OF THE INVENTION

The present invention relates to a retainer for positionally locating a shoulder strap of a handbag or the like relatively to the shoulder of a user, and more particularly to a retainer adapted for attachment to the skin on the shoulder of a user, so as to permit retention of a shoulder strap when a user is wearing a strapless garment, as well as when wearing a shoulder covering garment, without requiring modification of or damage to such shoulder covering garment.

The present invention generally contemplates a retainer having a base member carrying a suitable adhesive adapted for removably attaching the retainer to the skin on the shoulder of a user and a retainer member arranged to upstand from the base member and provide a recess for receiving a shoulder strap of a handbag or the like. The retainer may be made available in a package containing retainers whose retainer members define differently sized recesses, so as to accommodate for shoulder straps of differing thickness and/or to permit the retainer to be used under garments whose shoulder areas are formed from materials of different thickness.

In a preferred construction, the base member is only partially coated with an adhesive, so as to provide a nonadhering extension or end portion which may be folded back over an adjacent adhered portion of the base member, and the retainer member is defined by a two-part fastener device carried one part on each of the extension and the adjacent adhered portion.

BRIEF DESCRIPTION OF THE DRAWINGS

The nature and mode of operation of the present invention will now be more fully described in the following detailed description taken with the accompanying drawings wherein:

FIG. 1 shows a shoulder bag strap retainer of the present invention arranged in operative position on the shoulder of a user;

FIG. 2 is an enlarged perspective view of the retainer of FIG. 1, but in the configuration it would normally assume prior to attachment to the shoulder of a user;

FIG. 3 is a side elevational view of the retainer in operative condition; and

FIG. 4 is an exploded perspective view illustrating an alternative form of the present invention.

DETAILED DESCRIPTION

A retainer formed in accordance with the present invention is generally designated as 10 in the drawings and shown for example in FIG. 1 as being applied to the skin on the shoulder 12 of a user for purposes of removably retaining or positionally locating a shoulder strap 14 of a shoulder handbag or the like 16 of known or desired construction on such shoulder.

Retainer 10 is best shown in FIG. 2 and 3 as generally including a base member 18 and a retainer member 20. Base member 18 is depicted as being in the form of a pliable, relatively thin, elongated sheet or strip having a lower or mounting surface **18*a* and an oppositely facing upper or attachment surface 18*b*. At least a portion of mounting surface 18*a* is coated with a layer of adhesive material 22 capable of removably attaching retainer 10 to the skin of a user without injury thereto, and a peel away or protecting strip 24 is removably adhered to and sized to overlie adhesive 22 until retainer 10 is ready for application to the shoulder of a user. In the presently preferred construction shown in FIGS. 1–3, adhesive 22 is not applied to a generally rectangular, and comparably small area of mounting surface 18*a* disposed immediately adjacent one end of base member 18, so as to define an extension or end portion 26**, which is not capable of being adhered to a user's skin.

In the construction shown in FIGS. 1–3, retainer member 20 is defined by a two-part fastener device, such as a commonly available two-part, snap attached type button or fastener having cooperating male and female button parts **20*a* and 20*b*, which are permanently secured, as by a compatible adhesive, to attachment surface 18*b* in a spaced apart relationship lengthwise of base member 18 to overlie or be aligned with end portion 26 and adhesive material 22, respectively, as best shown in FIG. 2**.

The spacing between button parts **20*a* and 20*b* is preferably just sufficient to allow upwardly directed folding of end portion 26 adjacent an end border 22*a* of adhesive 22 to permit snap fitting engagement of part 20*a* within part 22*b*, as best shown in FIG. 3. Thus, when retainer member 20 is in its assembled condition, it is arranged in overlying relation to adhesive layer 22** and immediately adjacent one end thereof.

Again referring to FIG. 1, it will be understood that when the button parts are snapped together, they cooperate to define an annular retaining surface, which upstands from base member surface **18*b* sufficiently to define an abutment tending to prevent shoulder strap 14 from sliding off a user's shoulder. In the preferred form of the present invention, the fastener device chosen for use is characterized in that a mounting base portion 28 of button part 20*a* is of larger diameter than the base of button parts 20*b*, such that when the button parts are snapped together, the mounting base provides a downwardly facing, outwardly projecting annular surface 30, which bounds the upper edge of the strap retaining surface and cooperates with the peripheral surface 32 of button part 20*b* and an adjacent portion of surface 18*b* of base member 18 to define an annular, radially outwardly facing, concave retaining recess 34, which is transversely sized to freely receive shoulder strap 14 therewithin when the latter is placed over surface 18*b*** and slid towards retainer member 20 in the manner shown in broken line in FIG. 3. While a suitable strap retaining surface of generally cylindrical construction would be formed by employing button parts of like diameter, it is preferable to relatively size the button parts to provide surface 30, which serves as a safety latch preventing removal of shoulder strap 14 from engagement with the retaining surface in a direction normal to the shoulder of a user. In either case, however, the strap retaining surface is an annularly extending surface, which allows the shoulder strap to freely swing and move lengthwise within a plane disposed parallel to the adhered portion of base member 18, so as to minimize the tendency for forces acting on the shoulder strap to separate retainer 10 from the shoulder of the user.

It is contemplated that retainer 10 will be marketed in a package containing a group or series of retainers each maintained in a flatwise condition, as shown in FIG. 2. As desired, the retainers may be made available as like size units, but preferably same will be marketed in groups of retainers of progressively increasing size to accommodate for use with strapless attire, as shown in FIG. 1, and under garments whose shoulder areas are formed from materials of different thicknesses. Specifically, it is contemplated that the retainers will vary in size as regards the axial dimensions of button parts **20*a* and/or 20*b***, whereby to provide retainer recesses of progressively increasing transverse dimension or size.

In use, a minimum size retainer would normally be chosen for use with strapless attire. A user may place retainer 10 in use by folding over end portion 26 and snap fitting the button parts together, removing protecting strip 24 to expose adhesive 22 and then applying the retainer to the user's skin on the shoulder with the lengthwise dimension of the retainer aligned with a line extending between the user's neck and arm and with retainer member 20 disposed relatively remotely of such neck, as shown in FIG. 1. After application of retainer 10 to the user's shoulder, shoulder strap 14 may be positioned on base member surface **18*b* and the natural tendency of such strap to slide downwardly along the shoulder away from the neck automatically places/-retains the strap against the retaining surface of retainer member 20 and within retaining recess 34. The same size retainer could also be adapted for use under garments, including blouses and lightweight sweaters, having shoulder areas formed of relatively thin materials. In this instance, retainer 10** would be applied to the shoulder in the same manner as that described above before dressing in a chosen garment. Thereafter, when the shoulder strap is draped over the garment, the material forming its shoulder area would simply deform under the weight of the shoulder bag and allow the shoulder strap and adjacent portion of the garment material to enter the retaining recess. As the weight or thickness of the garment material increases, and/or garments are applied on upon the other in a layered fashion, it will eventually become necessary to choose to employ a larger size retainer in order to create a sufficiently high stop or abutment available to prevent slipping of a shoulder strap off the user's shoulder.

In the alternative construction of the present invention shown in FIG. 4, retainer 10' generally comprises a base member 18' and a retainer member 20' comprised of a common female button part **20*b*' fixed to base member attachment surface 18*b*' and a plurality of differently sized, male button parts 20*a*' selectively removably snap fitted to the female button part, as required to accommodate the retainer for use with both strapless garments and garments formed of varying thickness materials. In this construction, the whole of base member mounting surface 18*a*' may be coated with a layered adhesive 22' and two protecting strips 24' may be removably applied thereto. Button parts 20*a*' are each characterized in that same have a mushroom shaped configuration including a free standing, exposed shank portion 36 terminating in an enlarged head portion 28'. In this construction, a downwardly facing, outwardly projecting annular surface 30' of head portion 28' cooperates with the cylindrical surface 36*a* and the flared base 36*b* of shank portion 36 to define an annular radially outwardly opening, concave retaining recess 34'. Alternatively, flared base 36*b* may be eliminated and the diameter of cylindrical surface 36*a* enlarged, such that recess 34' is defined by surfaces 30' and 36*a* acting in cooperation with the radially outer surface 32' of button part 20*b*' and an adjacent portion of base member surface 18*b*'. However, male button parts 20*a*' fitted with flared bases 36*b* is preferred in that the weight applied to such flared bases, when a shoulder strap is positioned within recesses 34', tends to prevent accidental removal of the male button parts from snap fitting engagement within the common female button part, during use of retainer 10'**.

Also, in the alternative construction of FIG. 4, base member 18' is shown as being provided with end enlargements 38, which both add a decorative effect to the retainer and serve to increase the area of adhesive layer 22' available for shoulder attachment purposes. If desired, decorative indicia may also be applied to or printed on base member surface **18*b*'**.

Inasmuch as retainers 10 and 10' are intended to be applied to the skin of a user, it would be preferable to choose an adhesive from the types known for use in removably attaching medical type bandages or dressings to the skin in order to minimize skin irritation, while insuring that the retainers remain in place until intentionally removed. Also, if desired, base members 18 and 18' may be apertured in order to afford access by the skin beneath the base members to air circulation.

While the present invention has been described with reference to the use of two-part snap fasteners to define their retainer members, it is contemplated that other types of two-part fasteners, including for example Velcro strips, may be employed, if desired.

What is claimed is:

1. A shoulder strap retainer adapted for attachment to the skin of a user for purposes of preventing said shoulder strap for sliding off the shoulder of a user, said retainer comprising:

a base member having a mounting surface carrying a layer of adhesive for removably attaching said mounting surface to the skin of said shoulder and an oppositely facing surface; and retainer means attached to said oppositely facing surface and defining a retaining surface arranged upon attachment of said base member to said shoulder to upstand therefrom for engagement by said shoulder strap to prevent sliding thereof off said shoulder, and said retaining surface extends annularly of said retainer means.

2. A retainer according to claim 1, wherein said retaining surface is a recess of concave cross-section.

3. A shoulder strap retainer adapted for attachment to the skin of a user for purposes of preventing said shoulder strap from sliding off the shoulder of a user, said retainer comprising:

a base member having a mounting surface carrying a layer of adhesive for removably attaching said mounting surface to the skin of said shoulder and an oppositely facing surface; and retainer means attached to said oppositely facing surface and defining a retaining surface arranged upon attachment of said base member to said shoulder to upstand therefrom for engagement by said shoulder strap to prevent sliding thereof off said shoulder, said retainer means is defined by a fastener having two parts releasably attached to one another, one of said parts is attached to said oppositely facing surface and the other of said parts is provided as a series of parts of varying size to selectively vary the width of said retaining surface as measured normal to said oppositely facing surface.

4. A shoulder strap retainer adapted for attachment to the skin of a user for purposes of preventing said shoulder strap from sliding off the shoulder of a user, said retainer comprising:

a base member having a mounting surface carrying a layer of adhesive for removably attaching said mounting surface to the skin of said shoulder and an oppositely facing surface; and retainer means attached to said oppositely facing surface and defining a retaining surface arranged upon attachment of said base member to said shoulder to upstand therefrom for engagement by said shoulder strap to prevent sliding thereof off said shoulder, said base member is elongated, said adhesive is applied to said mounting surface except for one end portion thereof to define an end extension of said mounting surface not subject to adhering to said skin, and said retainer means is a two-part fastener having the parts thereof fixed to said oppositely facing surface in alignment one with each of said adhesive and said end extension.

5. A retainer according to claim 4, wherein said parts are snap-fit connected to one another.

6. A retainer according to claim 5, wherein said parts cooperate to define said retaining surface when snap-fitted to one another.

7. A retainer according to claim 6, wherein said retaining surface is an annularly extending surface.

8. A retainer according to claim 7, wherein said retaining surface is of concave cross-section.

9. a retainer according to claim 7, wherein a first of said parts connected to said oppositely facing surface in alignment with said end extension has a mounting base portion having a diameter exceeding the diameter of a second of said parts connected to said oppositely facing surface in alignment with said adhesive, whereby to define a latch surface arranged to project radially outwardly of said second of said parts when said parts are connected to one another.

10. A shoulder strap retainer adapted for attachment to the skin of a user for purposes of preventing said shoulder strap from sliding off the shoulder of a user, said retainer comprising:

a base member having a mounting surface carrying a layer of adhesive for removably attaching said mounting surface to the skin of said shoulder and an oppositely facing surface; and retainer means attached to said oppositely facing surface and defining a retaining surface arranged upon attachment of said base member to said shoulder to upstand therefrom for engagement by said shoulder strap to prevent sliding thereof off said shoulder, and said retainer means includes a common part fixed to said oppositely facing surface and a plurality of other parts selectively, removably affixed to said common part to upstand therefrom relative to said oppositely facing surface, said other parts differing from one another in length whereby to vary the transverse dimension of said retaining surface as measured normal to said oppositely facing surface.

11. A retainer according to claim 10, wherein said other parts are of mushroom shaped configuration and removably snap-fit attached to said common member.

* * * * *